US009701126B2

(12) United States Patent
Norasak

(10) Patent No.: US 9,701,126 B2
(45) Date of Patent: Jul. 11, 2017

(54) FLUID EJECTION DEVICE

(71) Applicant: Funai Electric Co., Ltd., Osaka (JP)

(72) Inventor: Sam Norasak, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 14/672,672

(22) Filed: Mar. 30, 2015

(65) Prior Publication Data

US 2016/0288497 A1 Oct. 6, 2016

(51) Int. Cl.
*B41J 2/175* (2006.01)

(52) U.S. Cl.
CPC ..... *B41J 2/17503* (2013.01); *B41J 2/175* (2013.01); *B41J 2/1753* (2013.01); *B41J 2/17509* (2013.01)

(58) Field of Classification Search
CPC ..... B41J 2/1433; B41J 2/162; B41J 2/1632; B41J 2/14491; B41J 2/175; B41J 2/1753; B41J 2/17503; B41J 2/17509
USPC ..... 347/50
See application file for complete search history.

(56) References Cited

U.S. PATENT DOCUMENTS 5,933,172 A * 8/1999 Park ..... B41J 2/17509 347/85
6,079,823 A 6/2000 Droege
6,231,153 B1 5/2001 Elgee
6,776,479 B2 8/2004 Ardito et al.
7,938,523 B2 5/2011 Aldrich
2002/0015083 A1* 2/2002 Thorpe ..... B41J 2/175 347/85
2003/0025763 A1* 2/2003 Sturgeon ..... B41J 2/1752 347/49
2004/0257412 A1* 12/2004 Anderson, Jr. ..... B41J 2/17559 347/85

(Continued)

FOREIGN PATENT DOCUMENTS

JP 2003290686 10/2003
JP 2007173399 7/2007

(Continued)

OTHER PUBLICATIONS

Non-Final Office Action, dated Jun. 10, 2016, for U.S. Appl. No. 14/672,662, filed Mar. 30, 2015.

(Continued)

*Primary Examiner* — Huan Tran
*Assistant Examiner* — Alexander D Shenderov
(74) *Attorney, Agent, or Firm* — Amster, Rothstein & Ebenstein, LLP

(57) ABSTRACT

A fluid ejection system is disclosed, and comprises a fluid ejection device and an adapter. The fluid ejection device comprises a body defining an interior bore, a fluid reservoir, and a fluid ejection chip. The fluid reservoir defines an interior passage that receives a fluid and is in fluid communication with the interior bore of the body. The fluid ejection chip is coupled with the body and comprises one or more fluid ejection actuators. The fluid ejection chip has one or more interior fluid paths in fluid communication with the interior bore of the body so that the fluid ejection chip ejects the fluid upon activation of the one or more fluid ejection actuators. The adapter is coupled with the fluid reservoir and defines an interior passage in fluid communication with the interior passage of the fluid reservoir. The adapter is configured to interengage a fluid storage device.

16 Claims, 5 Drawing Sheets

(56) References Cited

U.S. PATENT DOCUMENTS

| | | | | |
|---|---|---|---|---|
| 2005/0012791 | A1* | 1/2005 | Anderson | B41J 2/14129 347/85 |
| 2006/0227173 | A1* | 10/2006 | Buchanan | B41J 2/14145 347/54 |
| 2007/0140904 | A1 | 6/2007 | Bremer et al. | |
| 2008/0259137 | A1 | 10/2008 | Geldenhuys | |
| 2013/0070021 | A1 | 3/2013 | Nishimura et al. | |
| 2013/0342618 | A1 | 12/2013 | Frasure et al. | |

FOREIGN PATENT DOCUMENTS

| | | |
|---|---|---|
| JP | 2009262057 | 11/2009 |
| JP | 2012086370 | 5/2012 |

OTHER PUBLICATIONS

Final Office Action, dated Jun. 17, 2016, for U.S. Appl. No. 14/672,688, filed Mar. 30, 2015.

Final Office Action, dated Sep. 16, 2016, for U.S. Appl. No. 14/672,662, filed Mar. 30, 2015.

* cited by examiner

FLUID EJECTION DEVICE

FIELD

This invention is related to fluid ejection devices, and in particular, to fluid ejection devices that minimize fluid waste.

BACKGROUND

In some applications, discrete quantities of fluid are deposited onto a surface, for example, pharmaceutical applications, chemical applications, industrial applications, and medical testing applications, to name a few. Accordingly, fluids may be transported from a fluid reservoir and applied to a target surface with a fluid applicator, such as, for example, a pipette or fluid dropper.

SUMMARY OF THE INVENTION

An object of the present invention is to provide a fluid ejection device for depositing predetermined quantities of fluid onto a target surface.

Another object of the present invention is to provide a fluid ejection device for ejecting a predetermined quantity of fluid while minimizing any remainder fluid to be stored in the fluid ejection device so that fluid waste is minimized.

According to exemplary embodiments of the present invention, a fluid ejection system is disclosed, and comprises a fluid ejection device and an adapter. The fluid ejection device comprises a body defining an interior bore, a fluid reservoir, and a fluid ejection chip. The fluid reservoir defines an interior passage that receives a fluid and is in fluid communication with the interior bore of the body. The fluid ejection chip is coupled with the body and comprises one or more fluid ejection actuators. The fluid ejection chip has one or more interior fluid paths in fluid communication with the interior bore of the body so that the fluid ejection chip ejects the fluid upon activation of the one or more fluid ejection actuators. The adapter is coupled with the fluid reservoir and defines an interior passage in fluid communication with the interior passage of the fluid reservoir. The adapter is configured to interengage a fluid storage device. The interior passage of the fluid reservoir, the interior bore of the body, and the one or more interior fluid paths are substantially devoid of obstructions such that the fluid is gravity fed to the fluid ejection chip upon entry into the interior passage of the fluid reservoir.

In embodiments, the adapter comprises a needle for penetrating a portion of the fluid storage device.

In embodiments, the needle comprises an interior channel for fluid communication with the fluid storage device.

In embodiments, a portion of the adapter coupled with the fluid reservoir is configured as a Luer fitting.

In embodiments, the one or more fluid ejection actuators are thermal ejection actuators.

In embodiments, the fluid ejection chip comprises a substrate, a flow feature layer disposed over the substrate, and a nozzle layer disposed over the flow feature layer.

In embodiments, the fluid ejection chip comprises a nozzle layer defining one or more nozzles.

In embodiments, the fluid ejection device further comprises an electrical connector in electrical communication with the fluid ejection chip.

In embodiments, the fluid reservoir is aligned with the interior bore of the body.

In embodiments, the fluid reservoir is axially aligned with the fluid ejection chip.

In embodiments, the interior passage of the adapter, the interior passage of the fluid reservoir, the interior bore of the body, and the one or more interior fluid paths are axially aligned.

In embodiments, the one or more interior fluid paths are substantially linear.

According to exemplary embodiments of the present invention, a fluid ejection system is disclosed, and comprises a fluid ejection printer, a fluid ejection device, an electrical connector, and an adapter. The fluid ejection printer comprises a housing and at least one of an internal power source or one or more electrical contacts in electrical communication with an external power source. The fluid ejection device comprises a body defining an interior bore, a fluid reservoir, and a fluid ejection chip. The fluid reservoir defines an interior passage that receives a fluid and is in fluid communication with the interior bore of the body. The fluid ejection chip is coupled with the body and comprising one or more fluid ejection actuators. The fluid ejection chip has one or more interior fluid paths in fluid communication with the interior bore of the body so that the fluid ejection chip ejects the fluid upon activation of the one or more fluid ejection actuators. The electrical connector is in electrical communication with the fluid ejection printer so that power is supplied from the fluid ejection printer to the fluid ejection chip. The adapter is coupled with the fluid reservoir and defines an interior passage in fluid communication with the interior passage of the fluid reservoir. The interior passage of the fluid reservoir, the interior bore of the body, and the one or more interior fluid paths are substantially devoid of obstructions such that the fluid is gravity fed to the fluid ejection chip upon entry into the interior passage of the fluid reservoir.

In embodiments, the fluid ejection printer comprises a carrier for coupling with the fluid ejection device.

In embodiments, the carrier is moveable with respect to the housing of the fluid ejection printer.

In embodiments, the fluid ejection printer comprises a controller.

According to exemplary embodiments of the present invention, a method of forming a fluid ejection system comprises: providing an elongate body comprising an engagement portion and an ejection portion and defining an interior bore, the ejection portion comprising a fluid reservoir defining an interior fluid channel; attaching a fluid ejection chip to the body so that an interior fluid path of the fluid ejection chip is in fluid communication with interior bore of the body and the interior fluid channel of the fluid reservoir, the interior fluid path, the interior bore, and the interior fluid channel together providing a fluid path that is substantially devoid of obstructions; and coupling an adapter to the fluid reservoir, the fluid reservoir configured for coupling with a fluid storage device.

In embodiments, the method further comprises the step of coupling a fluid storage device to the reservoir.

In embodiments, the method further comprises the step of coupling the fluid ejection device to a printer.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
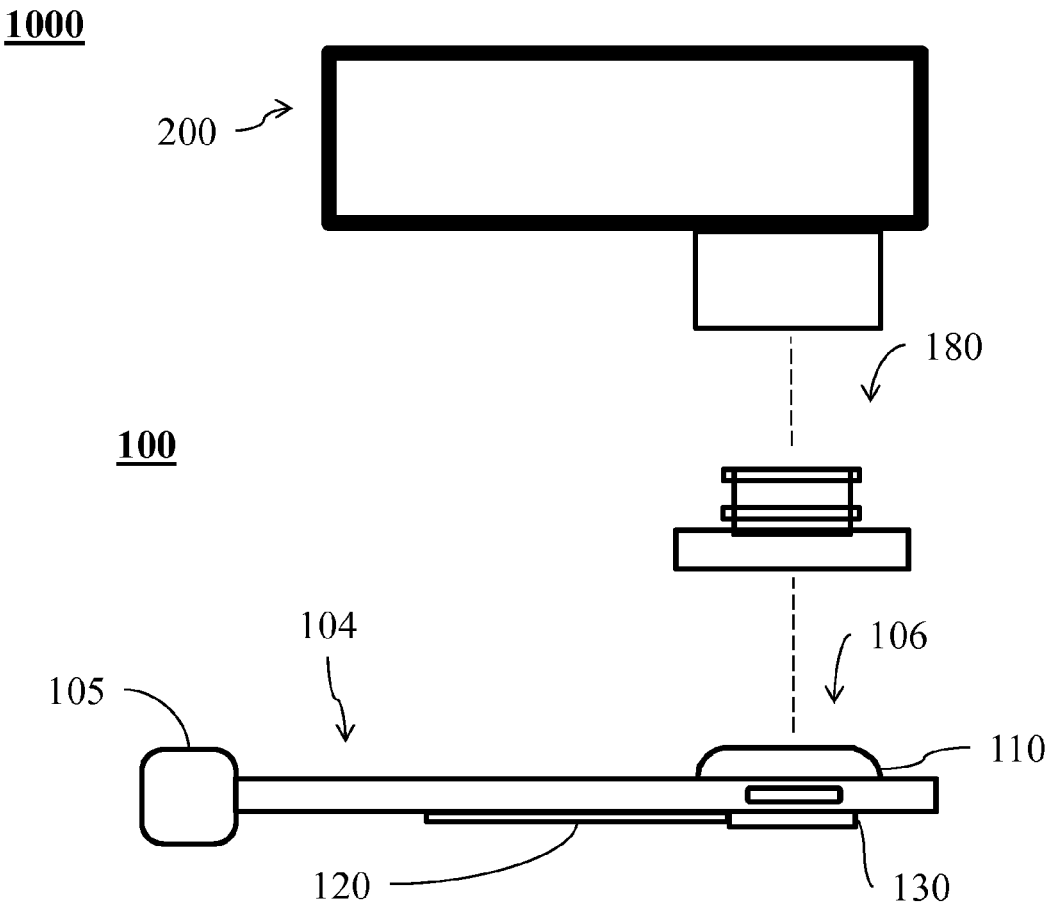
FIG. 1 is a side, parts-separated view of a fluid ejection system according to an exemplary embodiment of the present invention.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

Figure 2:
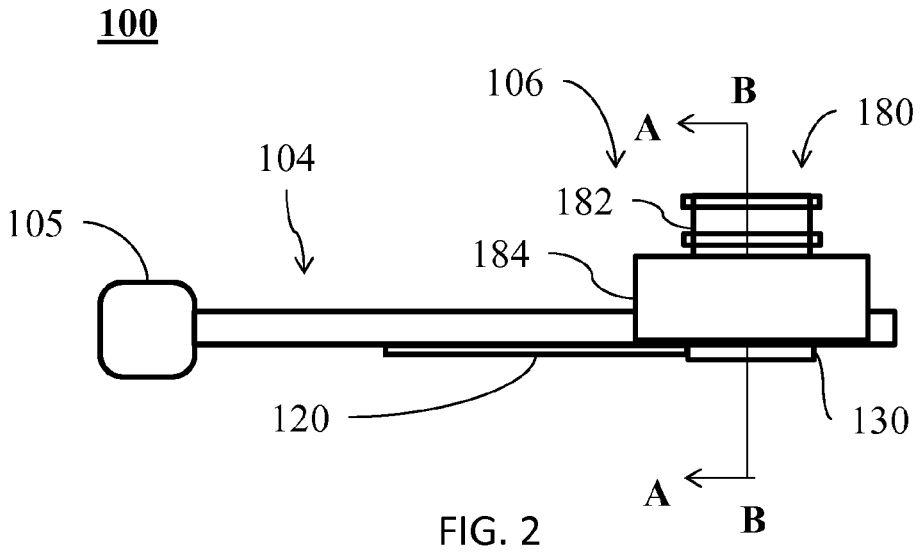
FIG. 2 is a side view of a fluid ejection device and an adapter of the fluid ejection system of FIG. 1.

Referring to FIG. 1 and FIG. 2, a fluid ejection system according to an exemplary embodiment of the present invention is illustrated, and is generally designated 1000. Fluid ejection system 1000 includes a fluid ejection device 100 and a fluid storage device 200. As described herein, fluid ejection device 100 is configured for coupling with fluid storage device 200 via an adapter 180 so that a quantity of fluid can be transferred from fluid storage device into fluid ejection device 100 for ejection onto a target surface.

Fluid ejection device 100 includes a body 102 along which a fluid reservoir 110, an electrical connector 120, and a fluid ejection chip 130 are disposed.

Body 102 may be an elongate member that includes a user engagement portion 104 and an ejection portion 106. User engagement portion 104 may include a surface feature 105 (e.g., a knob, bump, or ledge) to provide a user or grasping tool with a recognizable and easily-grasped region for handling fluid ejection device 100.

Ejection portion 106 includes fluid reservoir 110, fluid ejection chip 130, and at least a portion of electrical connector 120, as described further herein. Body 102 may be formed of one or more suitable materials for applications described herein, for example, glass, polymeric materials, and composite materials, to name a few. In embodiments, user engagement portion 104 and/or ejection portion 106 may have different configurations.

Figure 4:
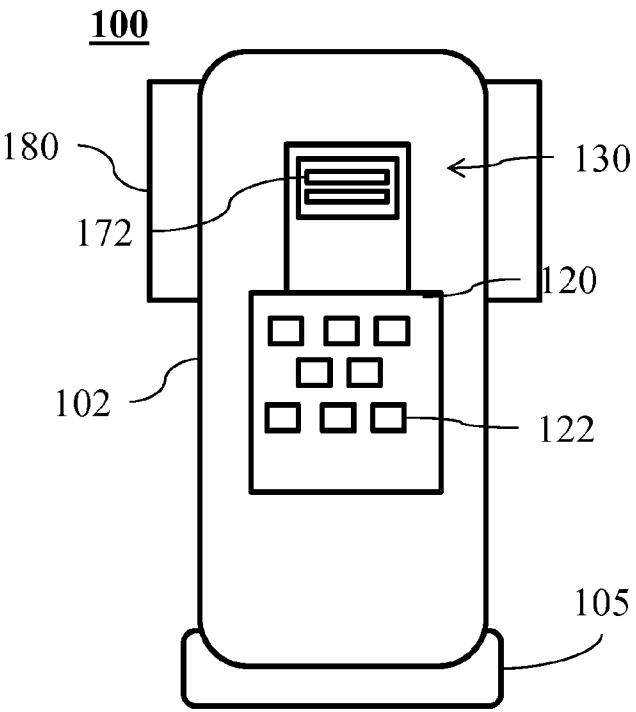
FIG. 4 is a bottom view of the fluid ejection device and adapter of FIG. 1.
Figure 3:
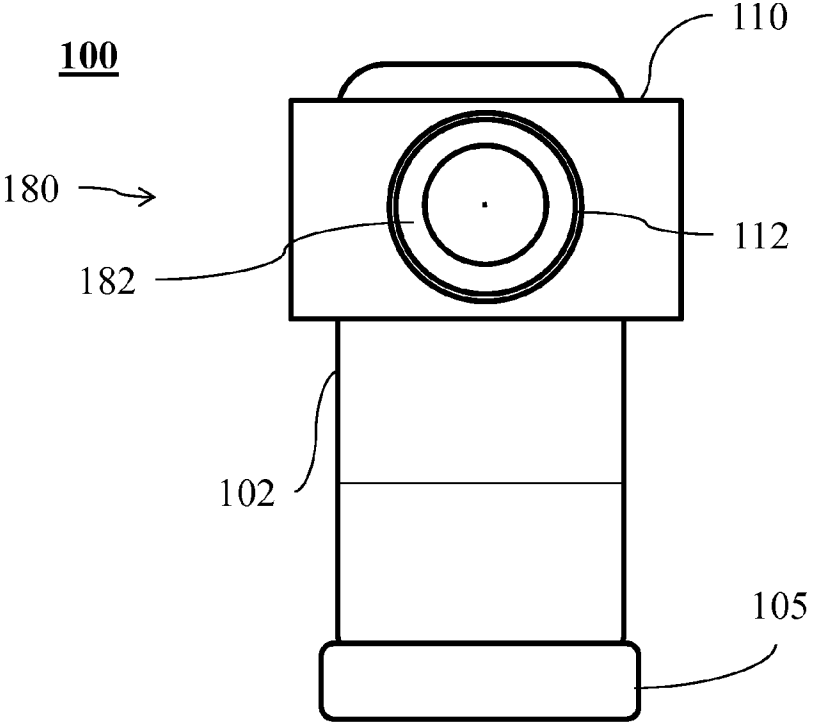
FIG. 3 is a top view of the fluid ejection device and adapter of FIG. 1.

Still referring to FIG. 1 and FIG. 2, and referring additionally to FIG. 3 and FIG. 4, electrical connector 120 extends along a portion of body 102 and is in electrical communication with fluid ejection chip 130 via one or more bond pads 122. Electrical connector 120 may be a tab automated bonded (TAB) circuit that includes electrical conductors (not shown) that can contact a portion of a fluid ejection system to provide electrical power for fluid ejection chip 130, as described further herein. In embodiments, electrical connector 120 may have a different configuration, for example, a configuration in which electrical connector 120 is interiorly disposed along at least a portion of body 102.

Fluid reservoir 110, as shown, protrudes from the surface of body 102 and presents an opening 112 into an interior fluid channel 114 (FIG. 5) extending through fluid reservoir 110. Fluid reservoir 110 may have a hollow, dome-shaped profile, as shown. Fluid reservoir 110 may be a separable component that is coupled to body 102, for example, by adhesion, welding, or mechanical coupling, to name a few. In embodiments, fluid reservoir 110 may be integrally formed with body 102. In embodiments, fluid reservoir 110 may have a different configuration, for example, a configuration in which fluid reservoir 110 is flush or recessed with the body 102 of fluid ejection device 100 and/or a configuration in which fluid reservoir 110 is not a curved structure.

Still referring to FIG. 1, FIG. 2, FIG. 3, and FIG. 4, adapter 180 is provided having a storage device portion 182 and an ejection device portion 184. Storage device portion 182 is configured for coupling with fluid storage device 200, as described further herein. Ejection device portion 184 may be configured for coupling with the body 102 of fluid ejection device 100. Accordingly, ejection device portion 184 of adapter 180 may define an interior chamber 112 dimensioned to at least partially receive fluid reservoir 110. Interior chamber 112 may have a profile similar to fluid reservoir 110 or may have a different configuration. As shown, ejection device portion 184 may include a pair of downwardly extending arms 194 extending from the ejection device portion 184 that receive the fluid reservoir 110 and a portion of the body 102 of ejection device 100 therebetween. The body 102 may include a pair of notches 103 for receiving an inwardly-extending tab 196 of each respective downwardly-extending arm 194 to provide a secure engagement between adapter 180 and fluid ejection device 100. Inwardly-extending tabs 196, as shown, may have a tapered profile to facilitate sliding engagement into notches 103 of the body 102 of ejection device 100. In embodiments, adapter 180 may be configured for removal from fluid ejection device 100, for example, by prying downwardly-extending arms 194 away from the fluid ejection device 100 manually or with a tool to disengage inwardly-extending tabs 196 from notches 103. In embodiments, adapter 180 may include different features for engaging a portion of fluid ejection device 100, for example, a different number of downwardly-extending arms 194 and/or a different configuration of tabs 196.

Tolerances of the ejection device portion 184 of adapter 180, e.g., dimensions of downwardly-extending arms 194 and/or inwardly extending tabs 196, as well as the position of notches 103 of body 102 of fluid ejection device 100, may be such that the adapter 180 exerts a downward, compressive force upon fluid reservoir 110 upon coupling with fluid ejection device 100. As shown, adapter 180 may include a sealing member 192 embedded within ejection device portion 184 and at least partially exposed to sealingly engage a portion of body 102 of fluid ejection device 100 upon coupling of adapter 180 and fluid ejection device 100. In this regard, sealing member 192 may provide a degree of fluid sealing, e.g., inhibition or prevention of leakage of fluids from fluid reservoir 110. In embodiments, adapter 180 may incorporate a different fluid sealing component.

In embodiments, fluid reservoir 110 may be coupled with adapter 180 in a different way, for example, a threaded coupling. In embodiments, ejection device portion 184 of adapter 180 may be adhered to fluid ejection device 100 or another portion thereof. In embodiments, adapter 180 may be integrally formed with fluid ejection device 100.

Fluid ejection chip 130 is disposed along the body 102 of fluid ejection device 102 on an opposite side from fluid reservoir 110 and adapter 180 such that one or more nozzles 172 of fluid ejection chip 130 are exposed facing a target surface upon which one or more fluids are to be deposited, for example, a testing slide or petri dish. As shown, adapter 180, fluid reservoir 110, and fluid ejection chip 130 are aligned along an axis B extending through fluid ejection device 100 such that a substantially linear and unobstructed fluid path is defined between the opening 112 of fluid reservoir 110 and nozzles 172 of fluid ejection chip 130, as described further herein. In embodiments, a substantially linear and unobstructed fluid path may be defined between a top opening of adapter 180 and nozzles 172 of fluid ejection chip 130. In this regard, fluids deposited into or through fluid reservoir 110 can be gravity fed to fluid ejection chip 130. In embodiments, fluid reservoir 110 may have a configuration such that a backpressure is provided to at least partially counteract the force of gravity on fluids deposited into fluid reservoir 110, e.g., to control a flow rate of fluid passing through fluid ejection device 100.

Turning to FIG. 4, an enlarged cross-sectional view of a portion of fluid ejection device 100 is shown, including adapter 180 coupled with fluid reservoir 110, and fluid ejection chip 130 mounted to the body 102.

Adapter 180, as shown, defines a hollow interior such that an interior passage 185 is provided in fluid communication with the interior fluid channel 114 of fluid reservoir 110. Accordingly, fluids deposited into adapter 180 may be directed into fluid reservoir 110, for example, through the influence of gravity, pressurization, and/or capillary action. In embodiments, adapter 180 may incorporate a fluid guide, for example, a funnel or other downwardly-oriented surface (not shown) to direct fluids into the opening 112 of fluid reservoir 110.

A needle 186 is interiorly mounted within the interior passage 185 of the adapter 180, and extends upwardly through the storage device portion 182 of adapter 180, as shown. Needle 186 may be configured to engage a portion of fluid storage device 200, as described further herein. In embodiments, needle 186 may define an interior passage such that fluids can travel therethrough.

A pair of sealing members 188 may be disposed about an exterior portion of adapter 180, for example, to aid in forming a substantially fluid tight seal between adapter 180 and fluid storage device 200 upon coupling, as described further herein. Sealing members 188 may be a pair of polymeric o-rings disposed about an outer surface of adapter 180. In embodiments, sealing members 188 may have a different configuration. In embodiments, a different number of sealing members may be provided.

Still referring to FIG. 4, the interior fluid channel 114 may widen downwardly in the direction of body 102, along a vertical distance of, for example, about 5 mm. In this regard, the interior fluid channel 114 may widen from a narrowest interior diameter at opening 112 of, for example, between about 5 mm and about 15 mm, to a widest interior diameter of, for example, between about 15 mm and about 25 mm where the fluid reservoir 110 meets the body 102. In embodiments, interior fluid channel 114 may widen from an interior diameter of, for example, 10 mm at the opening 112 to a diameter of, for example, 18 mm at the widest portion of interior fluid channel 114.

In this regard, fluid reservoir 110 is dimensioned to accommodate a volume of fluid. In embodiments, fluid reservoir 110 may be dimensioned to accommodate, for example, between about 1.8 $cm^3$ of fluid and about 4.1 $cm^3$ of fluid. In embodiments, fluid reservoir 110 may be dimensioned to accommodate about 0.5 grams of a water-based fluid.

As shown, body 102 includes an interior bore 108 upon which fluid reservoir 110 is disposed so that a fluid path is formed between the interior fluid channel 114 of the fluid reservoir 110 and the interior bore 108 of the body 102. Interior bore 108 may have a similar diameter to the interior diameter of the widest portion of fluid reservoir 110, for example, between about 15 mm and about 25 mm. In embodiments, interior bore 108 may have a different diameter.

Fluid ejection chip 130 may be mounted to body 102 in a suitable fashion, for example, adhesion, molding, or ultrasonic welding. In this regard, fluid ejection device 100 can be assembled by providing body 102 having fluid reservoir 110 and attaching fluid ejection chip 130 to a portion of body 102 such that an interior fluid path of the fluid ejection chip 130 is in fluid communication with the interior bore 108 of the body 102 and the interior fluid channel 114 of the fluid reservoir 110 to provide a substantially unobstructed fluid path.

Fluid ejection chip 130 may include a substrate 140, a plurality of fluid ejector elements 150, a flow feature layer 160, and/or a nozzle layer 170. In embodiments, ejection chip 130 may have a different configuration.

Substrate 140 may be formed of semiconductor and/or insulator materials, for example, silicon, silicon dioxide, sapphire, germanium, gallium arsenide, and/or indium phosphide, to name a few. A portion of the substrate 140 may be processed to form one or more fluid channels 144 in fluid communication with the interior bore 108 of the body 102. As described herein, processing portions of a fluid ejection chip may include, for example, mechanical deformation such as grinding, chemical etching, or patterning desired structures with photoresist, to name a few.

One or more ejector elements 150 may be disposed on the substrate 110. Ejector elements 150 may be comprised of one or more conductive and/or resistive materials so that when electrical power is supplied to the ejector elements 150, heat is caused to accumulate on and/or near the ejector elements 150 to eject fluid therefrom, as described further herein. In this regard, ejector elements 150 may be configured as thermal ejection actuators. In embodiments, ejector elements 150 may be formed of more than one layered material, such as a heater stack that may include a resistive element, dielectric, and protective layer. The amount of heat generated by ejector elements 150 may be directly proportional to the amount of power supplied to the ejector elements 150. In embodiments, power may be supplied to ejector elements 150 such that a predetermined thermal profile is generated by ejector elements 150, for example, a series of electrical power pulses of constant or variable amplitude and/or duration to achieve intended performance. In embodiments, ejector elements 150 may have a different electrical power configuration, for example, with the use of a piezoelectric element. In embodiments, an ejector element having a different configuration may be used with fluid ejection chip 130, for example, an ejector element that ejects fluid through the transfer of kinetic energy such as an electroactive polymer (EAP).

A flow feature layer 160 may be disposed over the substrate 140. Flow feature layer 160 may be disposed in a layered or otherwise generally planar abutting relationship with respect to substrate 140. Flow feature layer 160 may be formed of, for example, a polymeric material. Flow feature layer 160 may be processed such that one or more flow features 162 are formed along and/or within flow feature layer 160. In embodiments, flow features 162 may have geometry and/or dimensioning so that flow features 162 are configured to direct the flow of fluid through fluid ejection chip 130.

A nozzle layer 170 may be disposed over the flow feature layer 160. In embodiments, nozzle layer 170 may be disposed in a layered relationship with flow feature layer 160. In embodiments, nozzle layer 170 may be formed of, for example, a polymeric material. Nozzle layer 170 may be processed such that nozzles 172 are provided along an exposed surface of nozzle layer 170 as exit apertures for fluid being ejected from fluid ejection chip 130. Accordingly, nozzles 172 may have geometry and/or dimensioning configured to direct the trajectory of fluid exiting fluid ejection chip 130. Accordingly, fluid ejection chip 130 defines an interior fluid volume for accommodating fluid. The various features of fluid ejection chip 130 described herein may be processed in a way so that a desired interior volume is achieved.

Respective fluid channels 144, flow features 162, and/or nozzles 172 may collectively define one or more fluid paths within fluid ejector chip 130, such as fluid path $F_1$ and fluid path $F_2$ as shown, such that fluids can move from fluid reservoir 110, through fluid ejection chip 130, and exit through nozzles 172. As described herein, fluid paths $F_1$ and $F_2$ are substantially devoid of obstructions such that the opportunity of fluids to pool, trap, or otherwise become blocked is substantially minimized. Accordingly, the interior passage 185 of adapter 180, the fluid channel 114 of fluid reservoir 110 and the interior bore 108 of body 102, together with fluid paths $F_1$ and $F_2$, provide a substantially linear and unobstructed path through which fluids can flow so that substantially all of a fluid deposited into fluid reservoir 110 is ejected through nozzles 172. Further, by providing a fluid reservoir 110 having a desired interior volume, fluid ejector chip 130 can be provided such that a predetermined, discrete quantity of fluid is ejected onto a target surface while minimizing fluid waste due to the substantially linear and unobstructed fluid path provided by the interior configuration of fluid ejector chip 130.

Figure 6:
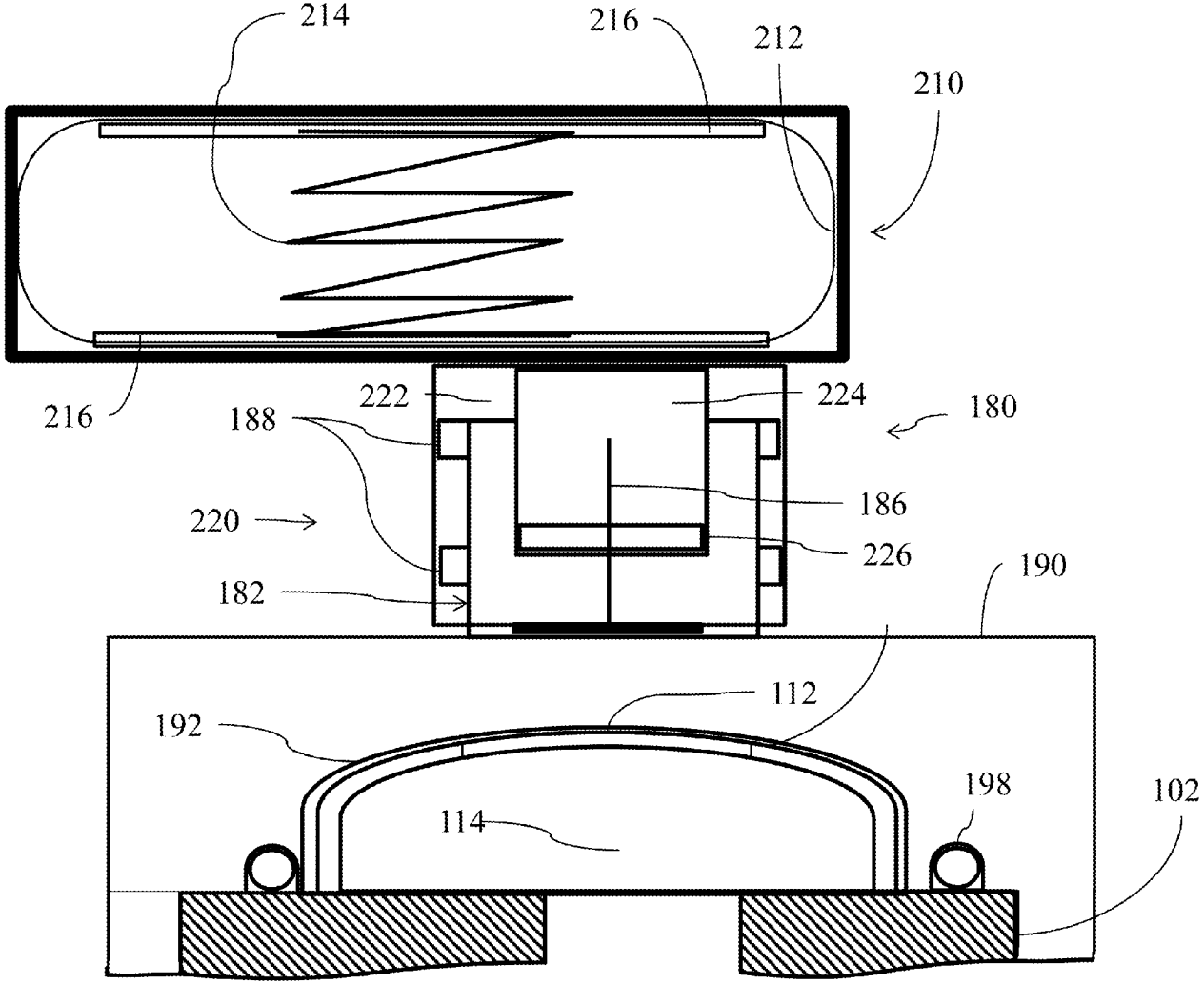
FIG. 6 is an enlarged cross-sectional view of a top portion of the fluid ejection device and adapter of FIG. 1 shown coupled with a fluid storage device.

Turning now to FIG. 6, a cross-sectional view of adapter 180 and an upper portion of fluid ejection device 100 are shown coupled with fluid storage device 200.

Fluid storage device 200, as shown, comprises an interior reservoir 210 and a fluid coupling portion 220 extending downwardly therefrom. Interior reservoir 210 is an interior volume of fluid storage device 200 at least partially occupied by a fluid retaining membrane 212, e.g., a bag or enclosed film, within which a quantity of fluid is held. Fluid retaining membrane 212 may be provided, so that fluids disposed within the fluid retaining membrane 212 are isolated, from example, from air, other environmental conditions, or contaminants, to name a few. Fluid retaining membrane 212 may provide a measure of protection against fluid leakage from fluid storage device 200 in addition to the walls surrounding interior reservoir 210. In embodiments, fluid storage device 200 may be provided such that fluid retaining membrane 212 and fluid stored therewithin may be removable from fluid storage device 200, e.g., so that fluid storage device 200 is configured as a modular component.

As shown, a biasing member 214 may be disposed between two plates 216 extending along the interior surface of fluid retaining membrane 212. Biasing member 214 may urge plates 216 outward, e.g., away from one another, such that an at least partial negative pressure environment, e.g., a backpressure, is generated within fluid retaining membrane 212 such that fluids disposed within fluid retaining membrane 212 do not, for example, drool, drip, leak, flow too quickly, or otherwise exhibit unintended characteristics. An example of a fluid backpressure mechanism of this type is disclosed in U.S. Patent Application Publication No. 2013/0342618, the entire contents of which are incorporated by reference herein.

Fluid coupling portion 220, as shown, defines a fitting recess 222 configured to interengage adapter 180, and an interior chamber 224 that is in fluid communication with the interior of fluid retaining membrane 212, e.g., through a fluid connections such as a tube or a valve such as a septum (not shown). A seal 226 is disposed along a downward-facing side of interior chamber 224, and maintains a substantially fluid-tight barrier between the interior chamber 224 of fluid coupling portion 220 and a surrounding environment. Seal 226 may be a deformable member, for example, a polymeric member such as an elastomer. In this regard, seal 226 may be at least partially reconfigurable, as described further herein.

As shown, fitting recess 222 of fluid coupling portion 220 receives at least a portion of storage device portion 182 of adapter 180. Accordingly, at least a portion of storage device portion 182 may be disposed within fitting recess 222 between an outer wall of fluid coupling portion 220 and an outer wall of interior chamber 224 of fluid coupling portion 220. In embodiments, storage device portion 182 of adapter 180 and/or fitting recess 222 of fluid coupling portion 220 may have a tapered configuration and may interengage via a press fit or threaded coupling, e.g., a Luer-type fitting. Sealing members 188 of adapter 180 may additionally become disposed within fitting recess 222, and may pressibly engage the walls of fluid coupling portion 220 to assist in maintaining a substantially fluid-tight barrier between fluid coupling portion 220 and a surrounding environment, e.g., to prevent leakage. In embodiments, storage device 200 and adapter 180 may interengage in a different type of coupling, for example, a threaded engagement, a tab and notch (clicking) arrangement, or snap fit, to name a few.

Upon coupling of fluid storage device 200 and adapter 180 as described above, needle 186 may penetrate and extend through seal 226 of fluid coupling portion 220 such that the substantially fluid-tight barrier provided by seal 226 is breached in a controlled manner. In embodiments, needle 186 may penetrate and dilate a portion of seal 226 such that fluids from fluid retaining member 222 can flow around needle 186 and into fluid reservoir 110 through adapter 180. In embodiments, needle 186 may define an interior passage such that upon penetration of seal 226 by needle 186, fluids from fluid retaining member 222 can enter the interior passage of needle 186 and flow through adapter 180 toward fluid reservoir 110.

Upon uncoupling of fluid ejection device 100 and fluid storage device 200, e.g., upon withdrawal of needle 186 of adapter 180 from seal 226 of fluid coupling portion 220 of fluid storage device 200, seal 226 may revert to a condition prior to penetration by needle 186, e.g., in a condition maintaining a substantially fluid-tight barrier between fluid coupling portion 220 and a surrounding environment. Accordingly, a dilation or puncture of seal 226 by needle 186 may contract upon withdrawal of needle 186. In this regard, seal 226 may have a resilient configuration, e.g., as in an elastomeric member. In embodiments, seal 226 may further incorporate one or more one-way sealing mechanisms, such as a valve.

Accordingly, fluid storage device 200 presents a device for the storage and/or release of fluids that may be configured for multiple uses, e.g., repeated instances of penetration of seal 226 by needle 186 and subsequent re-establishment of seal 226 upon withdrawal of needle 186. In this regard, fluid storage device 200 presents a re-usable component such that fluid storage device 200 may be used with multiple fluid ejection devices 100.

As described herein, fluid ejection device 100 may be suitable for use with, for example, relatively small quantities of fluid and accordingly may have a compact configuration. In this regard, fluid ejection device 100 may minimize manufacturing time and costs such that fluid ejection device 100 can be produced as a disposable device, e.g., a one-time use device, while fluid storage device 200 can be re-used until depleted of fluids so that no excess fluids need be discarded. It may be desirable to use a disposable printhead design in a number of fields of application such as medical and laboratory testing, for example, to avoid sample contamination.

Figure 7:
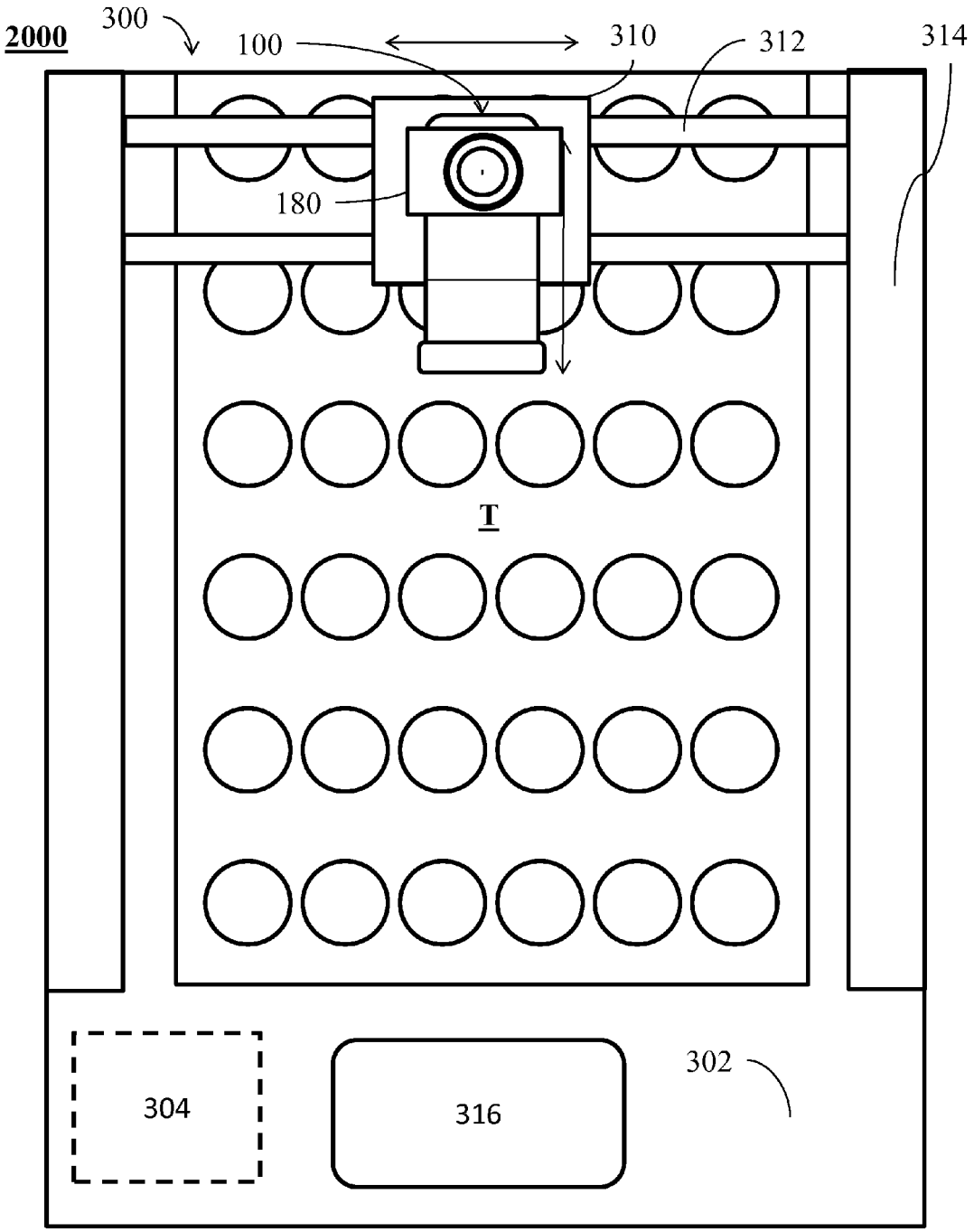
FIG. 7 is a top view of a fluid ejection system including the fluid ejection device of FIG. 1 according to an exemplary embodiment of the present invention.

Turning now to FIG. 7, a fluid ejection system according to an exemplary embodiment of the present invention is generally designated 2000. Fluid ejection system 2000 includes a fluid ejection printer 300 that is configured to interoperate with fluid ejection system 1000 (FIG. 1). Accordingly, printer 300 may be configured to receive at least a portion of fluid ejection device 100. While printer 300 is shown coupled with fluid ejection device 100 and adapter 180 for clarity, it will be understood that fluid storage device 200 (FIG. 1) may be coupled with adapter 180 on printer 300 as described herein. In embodiments, fluid ejection printer 300 may receive a differently-configured fluid ejection device. Also shown is a testing surface T which may be, for example, a group of test tubes or an array of recessed reservoirs into which fluid can be deposited. In embodiments, testing surface T may be, for example, a testing slide or petri dish. In embodiments, testing surface T may be provided on a portion of fluid ejection printer 200.

Fluid ejection printer 300 includes a housing 302 and at least one carrier 310 for receiving a portion of fluid ejection device 100. In this regard, carrier 310 may include an interior recess for receiving a portion of fluid ejection device 100 and/or may present a surface suitable for coupling with fluid ejection device 100, for example, a clip, clamp, or tab structure, to name a few.

Carrier 310 may also include an electrically conductive portion (not shown) for contacting and supplying electrical power through the electrical connector 120 (FIG. 4) of fluid ejection device 100, e.g., from an internal power source or an electrical power supply line. In this regard, carrier 310 provides a physical and electrical interface between fluid ejection device 100 and fluid ejection printer 200.

In embodiments, carrier 310 may be movable with respect to fluid ejection printer 300 along a series of rails with which carrier 310 is directly and/or indirectly slidable. As shown, carrier 310 may be slidably movable along a pair of lateral rails 312, which are each in turn slidably movable along a pair of lengthwise rails 314. In this regard, carrier 310 may be movable along a two-dimensional plane parallel to the testing surface T, e.g., an x-y grid.

Fluid ejection printer 300 may also include a controller 304 for effecting various electrically-powered functions, for example, firing of ejection actuators 150 (FIG. 5) of fluid ejection device 100. Accordingly, controller 304 may include or be electronically coupled with one or more processors that can read instructions from non-transitory computer memory. Electrically powered functions of fluid ejection printer 300 may be actuated manually by a user through an interface 316, which may be, for example, buttons, knobs, toggles, and/or capacitive touchscreens, to name a few.

Figure 5:
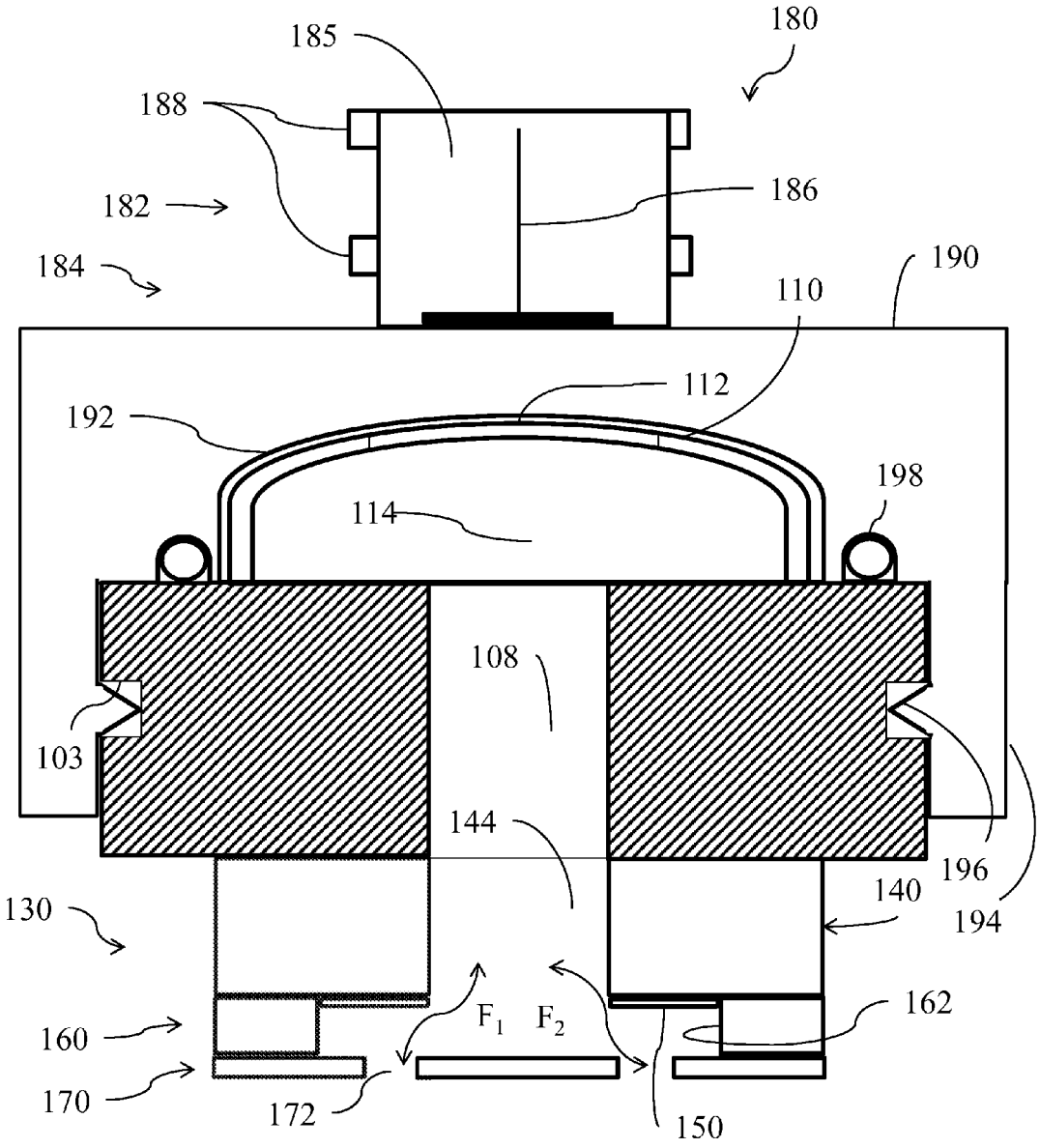
FIG. 5 is an enlarged cross-sectional view of the fluid ejection device and adapter of FIG. 1.

Referring to FIGS. 5 and 6, in use, a user may insert or otherwise mount fluid ejection device 100 to carrier 310 of fluid ejection printer 300. A quantity of fluid may then be deposited into the fluid reservoir 110 of fluid ejection device 100, for example, from fluid storage device 200 (FIG. 1) or directly into adapter 180 or fluid reservoir 110 with a pipette or dropper. In embodiments, a quantity of fluid may be deposited into fluid reservoir 110 by an automated device, for example, a portion of fluid ejection printer 300. The quantity of fluid that can be accommodated in fluid ejection device 100 depends upon the interior volume of the fluid reservoir 110, the volume of the interior bore 108 of body 102, and the interior volume of the fluid ejection chip 130.

Upon depositing fluid into the fluid ejection device 100, one or more electrical power pulses can be provided to fluid actuators 150 to cause flash vaporization and ejection of droplets of fluid from nozzles 172.

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A fluid ejection apparatus comprising:

a fluid ejection device comprising:

a body defining an interior bore and comprising an engagement portion;

a fluid reservoir defining an interior passage that receives a fluid, the interior passage in fluid communication with the interior bore of the body; and a fluid ejection chip coupled with the body and comprising one or more fluid ejection actuators, the fluid ejection chip having one or more interior fluid paths in fluid communication with the interior bore of the body so that the fluid ejection chip ejects the fluid upon activation of the one or more fluid ejection actuators; and an adapter coupled with the fluid reservoir and defining an interior passage in fluid communication with the interior passage of the fluid reservoir, the adapter defines an interior chamber that at least partially receives the fluid reservoir, the adapter interengages a fluid storage device;

wherein the interior passage of the fluid reservoir, the interior bore of the body, and the one or more interior fluid paths are substantially devoid of obstructions such that the fluid is gravity fed to the fluid ejection chip upon entry into the interior passage of the fluid reservoir, and wherein the engagement portion provides for a grasping engagement with the fluid ejection device during an operation of the fluid ejection chip.

2. The apparatus of claim 1, wherein the adapter comprises a needle for penetrating a portion of the fluid storage device.

3. The apparatus of claim 2, wherein the needle comprises an interior channel for fluid communication with the fluid storage device.

4. The apparatus of claim 1, wherein a portion of the adapter coupled with the fluid reservoir is a Luer fitting.

5. The apparatus of claim 1, wherein the one or more fluid ejection actuators are thermal ejection actuators.

6. The apparatus of claim 1, wherein the fluid ejection chip comprises a substrate, a flow feature layer disposed over the substrate, and a nozzle layer disposed over the flow feature layer.

7. The apparatus of claim 1, wherein the fluid ejection chip comprises a nozzle layer defining one or more nozzles.

8. The apparatus of claim 1, further comprising an electrical connector in electrical communication with the fluid ejection chip.

9. The apparatus of claim 1, wherein the fluid reservoir is aligned with the interior bore of the body.

10. The apparatus of claim 1, wherein the fluid reservoir is axially aligned with the fluid ejection chip.

11. The apparatus of claim 1, wherein the interior passage of the adapter, the interior passage of the fluid reservoir, the interior bore of the body, and the one or more interior fluid paths are axially aligned.

12. The apparatus of claim 1, wherein the one or more interior fluid paths are substantially linear.

13. A fluid ejection apparatus, comprising:

a fluid ejection printer comprising:

a housing; and at least one of an internal power source or one or more electrical contacts in electrical communication with an external power source;

a fluid ejection device comprising:

a body defining an interior bore and comprising an engagement portion;

a fluid reservoir defining an interior passage that receives a fluid, the interior passage in fluid communication with the interior bore of the body;

a fluid ejection chip coupled with the body and comprising one or more fluid ejection actuators, the fluid ejection chip having one or more interior fluid paths in fluid communication with the interior bore of the body so that the fluid ejection chip ejects the fluid upon activation of the one or more fluid ejection actuators;

an electrical connector in electrical communication with the fluid ejection printer so that power is supplied from the fluid ejection printer to the fluid ejection chip;

an adapter coupled with the fluid reservoir and defining an interior passage in fluid communication with the interior passage of the fluid reservoir, the adapter defines an interior chamber that at least partially receives the fluid reservoir;

wherein the interior passage of the fluid reservoir, the interior bore of the body, and the one or more interior fluid paths are substantially devoid of obstructions such that the fluid is gravity fed to the fluid ejection chip upon entry into the interior passage of the fluid reservoir, and wherein the engagement portion provides for a grasping engagement with the fluid ejection device during an operation of the fluid ejection chip.

14. The apparatus of claim 13, wherein the fluid ejection printer comprises a carrier for coupling with the fluid ejection device.

15. The apparatus of claim 14, wherein the carrier is moveable with respect to the housing of the fluid ejection printer.

16. The apparatus of claim 13, wherein the fluid ejection printer comprises a controller.

* * * * *